US007682198B1

(12) United States Patent
Plattner

(10) Patent No.: US 7,682,198 B1
(45) Date of Patent: Mar. 23, 2010

(54) POWER ADAPTER FOR AN AIRCRAFT

(76) Inventor: Wesley M. Plattner, 1146 Breyman Hwy., Tipton, MI (US) 48287

( * ) Notice: Subject to any disclaimer, the term of this patent is extended or adjusted under 35 U.S.C. 154(b) by 0 days.

(21) Appl. No.: 11/955,543

(22) Filed: Dec. 13, 2007

(51) Int. Cl.
*H01R 25/00* (2006.01)

(52) U.S. Cl. ..... 439/638; 439/652

(58) Field of Classification Search ..... 439/638, 439/652; 244/114 R
See application file for complete search history.

(56) References Cited

U.S. PATENT DOCUMENTS

| | | | | |
|---|---|---|---|---|
| 4,971,576 | A | 11/1990 | Thimmesch | |
| 5,697,810 | A | 12/1997 | Barry | |
| 6,424,891 | B1 | 7/2002 | Sargent et al. | |
| 6,907,332 | B1 | 6/2005 | Huynh et al. | |
| 2003/0036312 | A1* | 2/2003 | Liao | 439/638 |
| 2003/0181105 | A1* | 9/2003 | Lee | 439/638 |
| 2004/0011918 | A1 | 1/2004 | Musial et al. | |
| 2004/0137796 | A1* | 7/2004 | Sivertsen | 439/638 |
| 2004/0224562 | A1* | 11/2004 | Dolinshek et al. | 439/638 |
| 2005/0090152 | A1* | 4/2005 | Broomall et al. | 439/638 |
| 2006/0157987 | A1 | 7/2006 | Albrecht | |

* cited by examiner

*Primary Examiner*—Hien Vu
(74) *Attorney, Agent, or Firm*—Young Basile Hanlon & MacFarlane, P.C.

(57) ABSTRACT

A power adapter for an aircraft. The aircraft has an electrical system and an auxiliary electrical system disposed thereon, wherein the auxiliary electrical system is not integrated with the electrical system. The power adapter has a body portion, a first connector terminal disposed on the body portion for receiving electrical power from an external power source, a second connector terminal disposed on the body portion and electrically connected to the first connector terminal for supplying electrical power to the electrical system of the aircraft, and a third connector terminal electrically connected to the first connector terminal for supplying electrical power to the auxiliary electrical system.

10 Claims, 4 Drawing Sheets

POWER ADAPTER FOR AN AIRCRAFT

FIELD OF THE INVENTION

The invention relates to the field of ground power units for aircraft, and more particularly, the invention relates to a power adapter for connecting a ground power unit both to the primary power connector of an aircraft, as well as directly to an electrical device on board the aircraft.

BACKGROUND OF THE INVENTION

Many of the electronic systems that are present on an airplane are temperature sensitive and prone to premature failure if subjected to extreme heat. For this reason, airplanes must have cooling systems that maintain a reasonable temperature within the airplane while the aircraft is not in use in order to maintain the integrity of the electronic systems aboard the airplane. Most modern airport terminals have cooling systems that can be attached to an airplane to regulate its temperature while it is parked at the airport terminal. However, self-contained, on-board cooling systems are carried on airplanes to cool the electronic systems when an external cooling system is not available, for example, when the airplane is not parked at a terminal or is parked at a terminal where an external cooling system is not present. On-board cooling systems typically utilize large, petroleum-based motors for operating the cooling system and any other systems on the airplane that require power. However, such systems are not efficient, as the motors must run for one to two hours in order to sufficiently cool the electronic systems on board the airplane. Consequently, the operation of petroleum-based motors in conjunction with airplane cooling can be very expensive and is therefore undesirable in the aviation industry.

As an alternative to petroleum-based motors, electrical motors have been used to power cooling systems on airplanes. Of course, electrical motors must be provided with an electrical power supply so they may operate. Thus, when an airplane is retrofitted so that an electrical cooling system may be installed, the electrical cooling system must ordinarily be interconnected with the electrical systems on the airplane, so that the cooling system may be powered by a ground power unit. Such ground power units are ordinarily located at airports for use by aircraft that are parked there. The ground power units are connected to the aircraft using an electrical cable that is connected to an electrical connector that extends through the fuselage of the airplane. However, interconnecting the electrical cooling system with the electrical systems of the airplane would require reevaluation of the air worthiness of the airplane. Thus, the expense of such a design change would outweigh the benefits obtained by using the electrically-operated cooling system, and thus, the design change would not be warranted.

Before now, a power adapter for an aircraft that connects a ground power unit both to the electrical system of the aircraft through a power connector in the fuselage, as well as directly connecting the ground power unit to an on-board electrical device, such as an electrical air-conditioning unit, has not been known.

SUMMARY OF THE INVENTION

The invention provides a power adapter for an aircraft that has an electrical system and an auxiliary electrical system disposed thereon, wherein the auxiliary electrical system is not integrated with the electrical system. The power adapter has a body portion, a first connector terminal disposed on the body portion for receiving electrical power from an external power source, a second connector terminal disposed on the body portion and electrically connected to the first connector terminal for supplying electrical power to the electrical system of the aircraft, and a third connector terminal electrically connected to the first connector terminal for supplying electrical power to the auxiliary electrical system. The external power source may be a ground power unit, and the auxiliary electrical system may be an air conditioning unit.

A circuit breaker may be disposed within the body portion and electrically interposed between the first connector terminal and the third connector terminal.

The body portion may be fabricated from a high strength material. Furthermore, the body portion may be substantially rectangular, and the first connector terminal may be opposite the second connector terminal. Also, the first connector terminal and the second connector terminal may be axially aligned.

A first cable, a second cable, and a third cable may be provided. The first cable electrically connects the ground power unit to the first connector terminal. The second cable electrically connects the second connector terminal to the electrical system of the aircraft. The third cable electrically connects the third terminal to the air conditioning unit.

BRIEF DESCRIPTION OF THE DRAWINGS

The description herein makes reference to the accompanying drawings wherein like referenced numerals refer to like parts throughout several views and wherein.

DETAILED DESCRIPTION OF THE INVENTION

Figure 1:
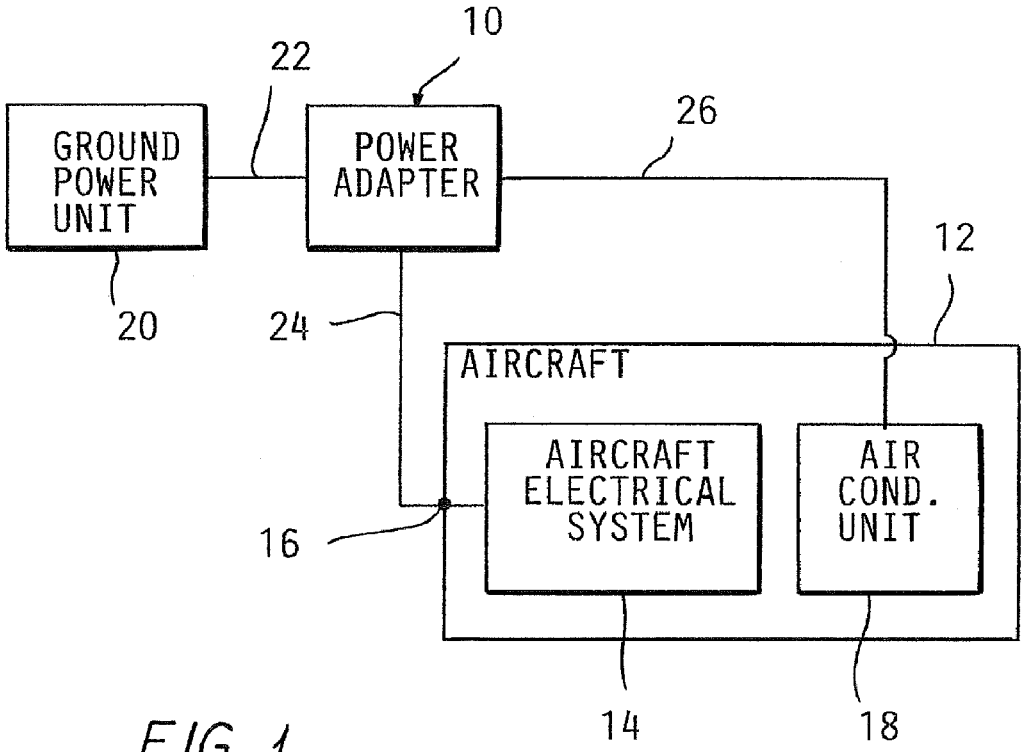
FIG. 1 is a block diagram showing connection of a ground power unit to an aircraft using the power adapter.

Referring to the drawings, the invention will be seen to most generally relate to a power adapter for an aircraft that connects a ground power unit both to the electrical system of the aircraft through a power connector in the fuselage, as well as directly connecting the ground power unit to an on-board electrical device, such as an electrical air-conditioning unit, which will now be described in detail with reference to exemplary embodiments.

As shown in FIG. 1, a power adapter 10 of the invention is applicable to an aircraft 12 having an electrical system 14 and an auxiliary electrical system, such as an air conditioning unit 18, disposed thereon. When the aircraft 12 is not in use, it is inefficient to use the on-board electrical generation systems of the aircraft 12 to supply electrical power to the aircraft electrical system 14 since these systems typically employ fuel-based engines that consume large quantities of fuel. Thus, parked aircraft 12 are often connected to an external power source, such as a portable ground power unit 20 or any other suitable electrical power source, which is connected to the aircraft electrical system 14 by an electrical connector 16 disposed on the exterior of the aircraft 12. However, the air conditioning unit 18 is not integrated into the electrical system 14 of the aircraft 12, and thus, the aircraft 12 may be retrofitted to include the air conditioning unit 18 without incurring the expense of integrating the air conditioning unit 18 into the aircraft electrical system 14. This also allows the regulatory certifications that would be needed to integrate the air conditioning unit 18 with the electrical system 14 of the aircraft 12 to be avoided. Thus, the air conditioning unit 18 does not receive electrical power through the electrical connector 16.

In order to supply electrical power from the ground power unit 20 to the electrical system 14 of the aircraft 12, as well as provide electrical power to the air conditioning unit 18, the power adapter 10 is connectable to a first cable 22, a second cable 24, and a third cable 26. In particular, the power adapter 10 is configured to receive power from the ground power unit 20 by way of the first cable 22. The power adapter 10 is further configured to supply power to the electrical system 14 of the aircraft 12 by way of the second cable 24. Finally, the power adapter 10 is configured to supply power to the air conditioning unit 18 of the aircraft 12 by way of the third cable 26.

Figure 2:
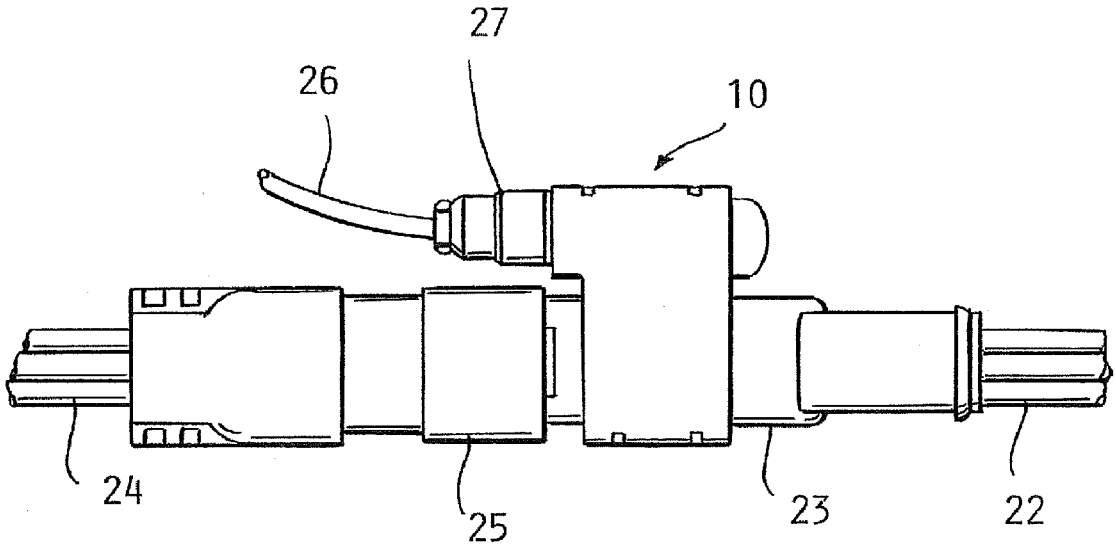
FIG. 2 is an illustration showing the power adapter connecting to a first cable, a second cable, and a third cable.

In order to supply the necessary amount of electrical power to the aircraft electrical system 14, the first cable 22 and the second cable 24 are fabricated from heavy gauge multiple conductor cables, as shown in FIG. 2. For example, the first cable 22 and the second cable 24 may include four zero gauge (No. 0 AWG) conductors and two twelve gauge (No. 12 AWG) copper conductors. Thus, it can be appreciated that the first cable 22 and the second cable 24 may be quite heavy, as in the example above, where the copper conductors alone weigh approximately 1.3 pounds per linear foot of either the first cable 22 or the second cable 24. The first cable 22 has a multiple pin female connector 23 for connection with the power adapter 10, and the second cable 24 has a multiple pin male connector 25 for connection with the power adapter 10. However, it should be understood that the invention is not limited to any particular type of connector on the first cable 22 and the second cable 24. On the opposite ends of the first cable 22 and the second cable 24, appropriate connectors are provided for connection to the ground power unit 20 and the electrical connector 16 of the aircraft 12, respectively.

The third cable 26 is a medium gauge multiple conductor cable. For example, the third cable 26 may have four six gauge (No. 6 AWG) copper conductors. In order to connect the third cable 26 to the power adapter 10, the third cable 26 has a multiple-pin circular connector 27. On the opposite end of the third cable 26, an appropriate connector may be provided for connection to the air conditioning unit 18.

Figure 3:
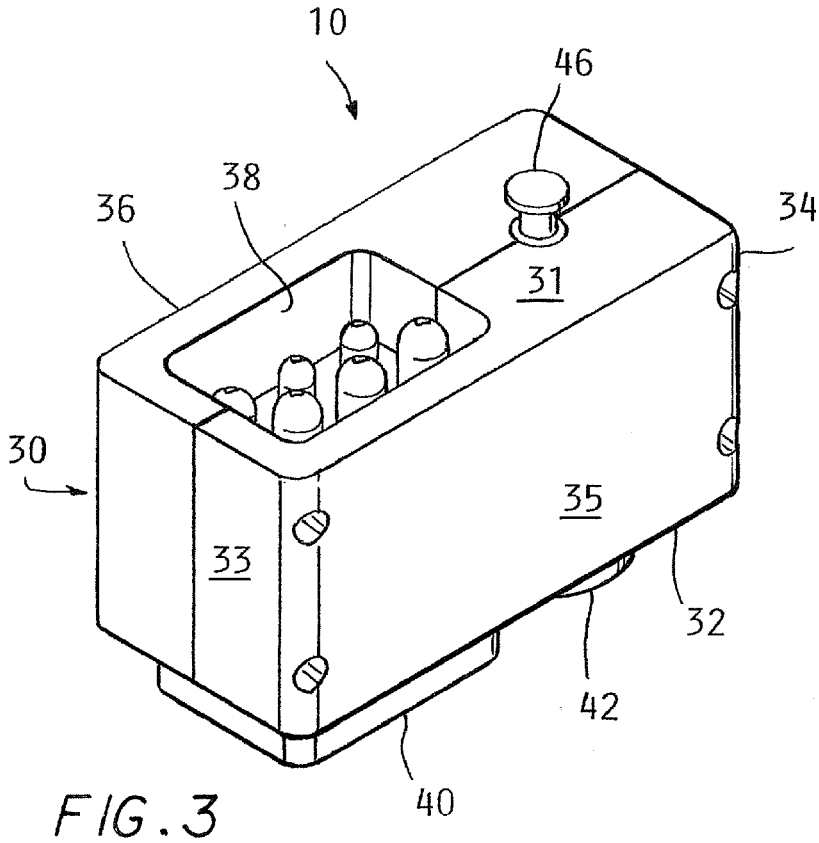
FIG. 3 is a perspective view of the power adapter.

As shown in FIG. 3, the power adapter 10 has a substantially rectangular body portion 30. The body portion 30 includes a front surface 31 and a rear surface 32, upon which all of the terminals and other elements situated on the exterior of the body portion 30 are disposed. In contrast, a first side surface 33, a second side surface 34, a top surface 35, and a bottom surface 36 of the body portion 30 are substantially continuous. However, it is noted that the top surface 35 and the bottom surface 36 are the largest surfaces of the body portion 30 and are adapted to serve as supporting surfaces for the body portion 30. Furthermore, by keeping the height of the body portion 30 small, wherein the height is the common dimension of the front and rear surfaces 31, 32 and the first and second side surfaces 33, 34, the body portion 30 does not create an obstruction to workers or vehicles in the vicinity of the aircraft. Thus, it is contemplated that the height of the body portion 30 may be the smallest dimension of the body portion 30 in that it is smaller than the width of the body portion 30, which is defined as the common dimension of the front and rear surfaces 31, 32 and the top and bottom surfaces 35, 36 of the body portion 30. Additionally, the body portion 30 is constructed from a high-strength material such as steel, aluminum, or high-strength plastics, which allows the power adapter 10 to be run over by a vehicle without sustaining substantial damage.

Figure 4:
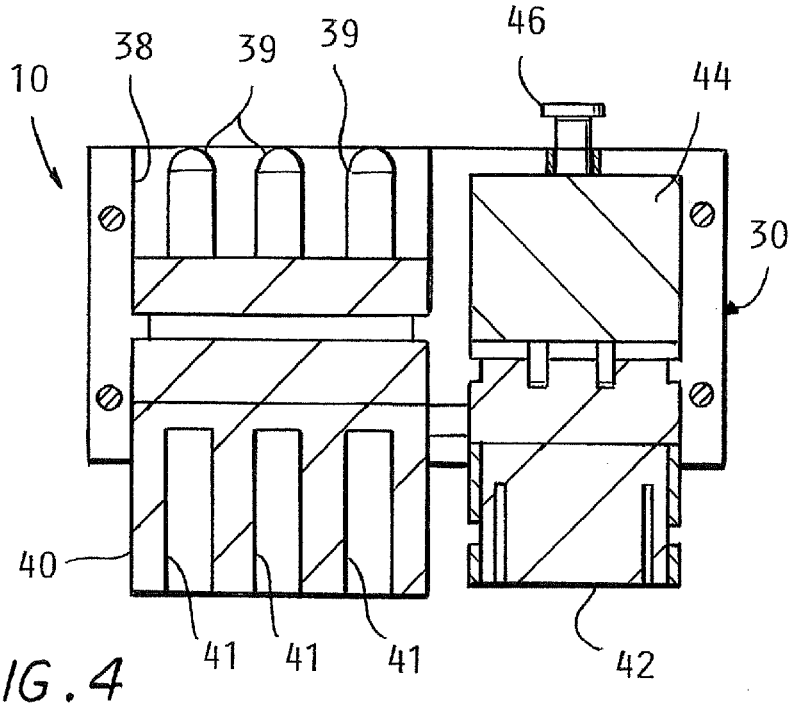
FIG. 4 is a sectional view of the power adapter.

In order that the power adapter 10 may receive electrical power from the ground power unit 20, the power adapter 10 has a first connector terminal 38. The first connector terminal 38 may be a multiple pin male connector having a plurality of connector pins 39, as shown in FIG. 4. However, it should be understood that the first connector terminal 38 may be any electrical connector that complementarily engages the connector 23 of the first cable 22. The first connector terminal 38 is formed on the body portion 30, in particular, on the front surface 31. The first connector terminal may be recessed into the body portion 30 or extend outward therefrom.

To supply electrical power to the electrical system 14 of the aircraft 12 by way of the electrical connector 16, the power adapter 10 has a second connector terminal 40 that is electrically connected to the first connector terminal 38 for transmission of electrical power therefrom. The second connector terminal 40 may be fabricated from a multiple pin female connector having a plurality of connector recesses 41. However, it should be understood that the second connector terminal 40 may be any electrical connector that complementarily engages the connector 25 of the second cable 24. The second connector terminal 40 is formed on the body portion 30, in particular, on the rear surface 32. The second connector terminal 40 may be recessed into the body portion 30 or extend outward therefrom. Furthermore, the second connector terminal 40 may be directly opposite the first connector terminal 38 and axially aligned therewith. It should be noted that this arrangement of the second connector terminal 40 with respect to the first connector terminal 38 places both the first and second connector terminals 38, 40 near the top and bottom surfaces 35, 36 of the body portion 30, thereby allowing the first and second cables 22, 24 to be supported by the tarmac, ground, or other surface upon which the body portion 30 itself is supported, thus minimizing the risk that either of the first and second cables 22, 24 will become accidentally disconnected from the body portion 30 due to the weight of the first and second cables 22, 24.

In order that that the power adapter 10 may supply electrical power to the air conditioning unit 18, the power adapter 10 has a third connector terminal 42 that is electrically connected to the first connector terminal 38 for transmission of electrical power therefrom. The third connector terminal 42 may be a multiple pin circular connector or a connector that complementarily engages the connector 27 of the third cable 26. The third connector terminal 42 is formed on the body portion 30, in particular, on the rear surface 32. The third connector terminal 42 may be recessed into the body portion 30 or extend outward therefrom.

To prevent electrical damage to the air conditioning unit 18 caused by voltage spikes or surges in the power supply, the power adapter 10 may include a circuit breaker 44. The circuit breaker 44 is electrically interposed between the first connector terminal 38 and the third connector terminal 42. During normal operation, the circuit breaker 44 allows electrical power to flow from the first connector terminal 38 to the third connector terminal 42. However, in the event of a voltage spike or surge in the power supply, the circuit breaker 44 trips and disrupts the flow of electrical power from the first connector terminal 38 to the third connector terminal 42. The circuit breaker 44 is placed back into normal operation by a reset button 46 that is connected to the circuit breaker 44 and extends through the front surface 31 of the body portion 30.

Figure 5:
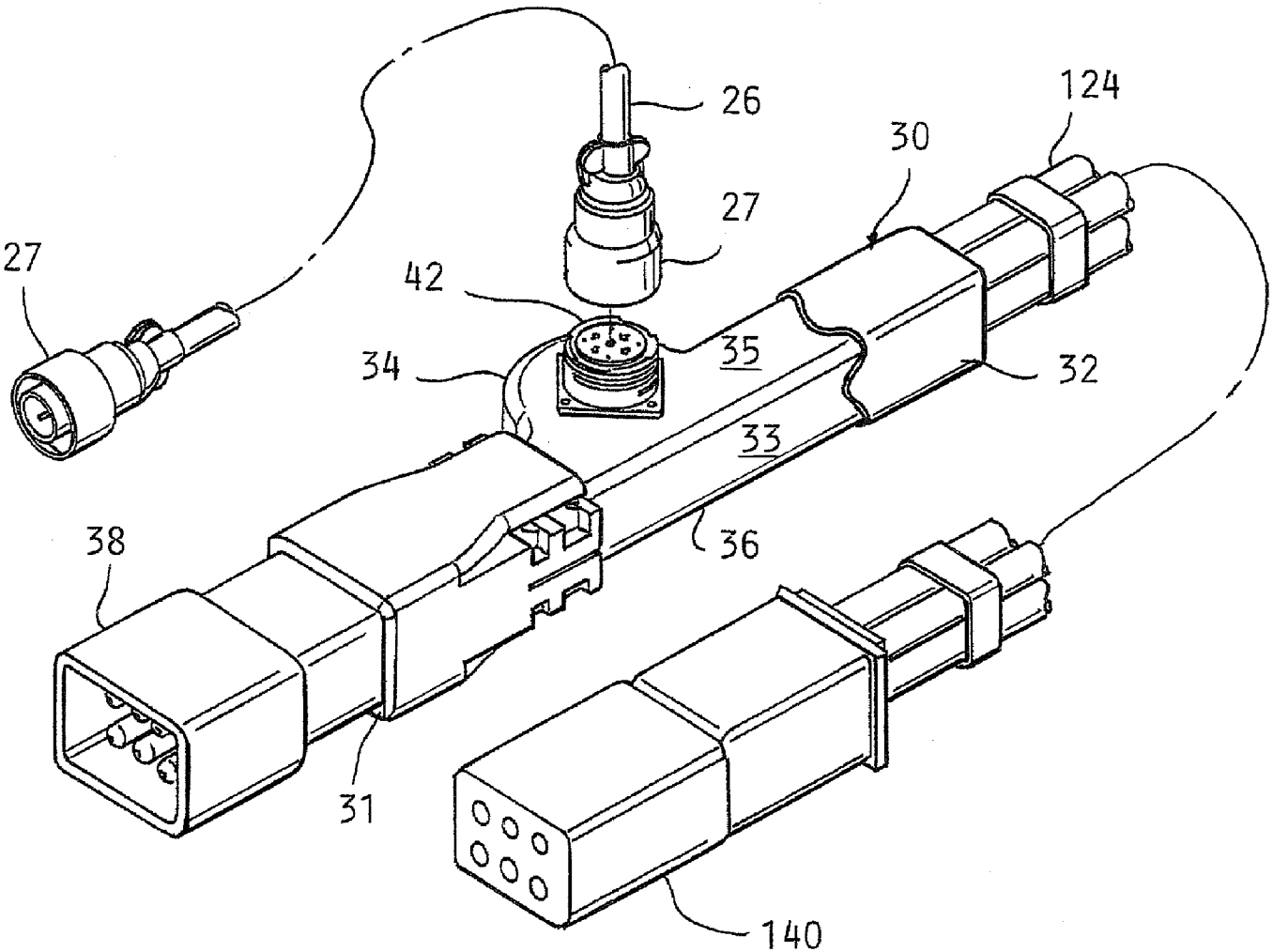
FIG. 5 is a perspective view of an alternative embodiment of the power adapter.

In an alternative embodiment, the body portion 30 may include an integral second cable 124 that is connected to the rear surface 32 of the body portion 30, as shown in FIG. 5. In this case, a second connector terminal 140 is disposed at the end of the integral second cable 124 opposite the body portion 30. Also, the body portion 30 is elongated and slender, such that the first connector terminal 38 dominates the front face 31 of the body portion 30, and the integral second cable 124 dominates the rear surface 32 of the body portion 30. Furthermore, it is specifically contemplated that the third connector terminal 42 may be disposed on the top surface of the body portion 30.

Figure 6:
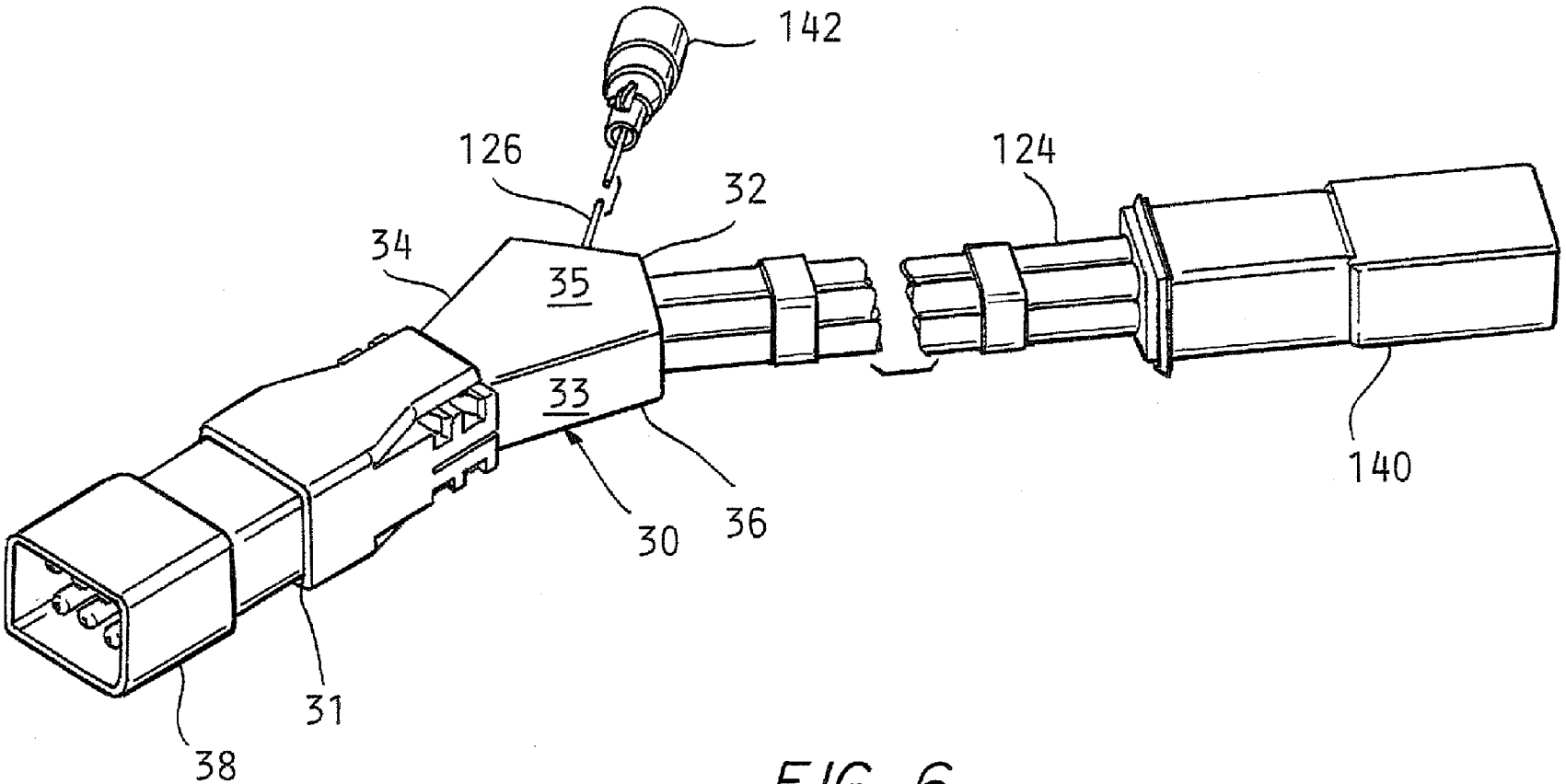
FIG. 6 is a perspective view of another alternative embodiment of the power adapter.

In yet another alternative embodiment, the body portion 30 may include an integral third cable 126 in addition to the integral second cable 124, as shown in FIG. 6. In this case, a third connector terminal 142 is disposed at the end of the integral third cable 126.

In use, a user wishing to supply power to the electrical system 14 of the aircraft 12, as well as to the air conditioning unit 18 on the aircraft 12, may connect the electrical system 14 and the air conditioning unit 18 to a ground power unit 20 using the power adapter 10. The user first connects the first cable 22 to the ground power unit 20 and to the power adapter 10. The user then connects the second cable 24 to the power adapter 10 and the electrical connector 16 of the aircraft 12. Next, the user connects the third cable 26 to the power adapter 10 and the air conditioning unit 18 of the aircraft 12. In order to do so, the user may place the third cable 26 through an opening in the aircraft 12, such as a window or door (not shown), or connect the third cable 26 to a dedicated electrical connector (not shown) on the exterior of the aircraft 12 that is connected to the air conditioning unit 18 but not connected to the electrical system 14.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims. The scope is to be accorded the broadest interpretation so as to encompass all such modifications and equivalent structures as is permitted under the law.

What is claimed is:

1. A power adapter for an aircraft having an electrical system and an auxiliary electrical system disposed thereon, wherein the auxiliary electrical system is not integrated with the electrical system, the power adapter comprising:

a substantially rectangular, substantially rigid body portion, the body portion having a bottom surface for supporting the body portion, a front surface that extends upward from the bottom surface, and a top surface that is spaced from the bottom surface by the front surface and a rear surface to define the height of the body portion, wherein the height of the body portion is the smallest dimension of the body portion, the first connector terminal is disposed in the front surface of the body portion, and the second connector is disposed in the rear surface of the body portion;

a first connector terminal disposed in the body portion for receiving electrical power from an external power source;

a second connector terminal disposed in the body portion and electrically connected to the first connector terminal for supplying electrical power to the electrical system of the aircraft, wherein the first connector terminal is opposite and axially aligned with the second connector terminal, the first connector terminal is disposed on the front surface of the body portion, and the second connector is disposed on the rear surface of the body portion; and a third connector terminal electrically connected to the first connector terminal for supplying electrical power to the auxiliary electrical system, wherein the third connector terminal is disposed in the rear surface of the body portion adjacent to the second connector, wherein the power adapter further comprises a circuit breaker disposed within the body portion and electrically interposed between the first connector terminal and the third connector terminal.

2. The power adapter of claim 1, wherein the body portion is fabricated from a high-strength material.

3. The power adapter of claim 1, wherein the first connector terminal is a multiple pin male connector terminal and the second connector terminal is a multiple pin female connector terminal.

4. A power adapter for an aircraft having an electrical system and an air conditioning unit disposed thereon, wherein the air conditioning unit is not integrated with the electrical system, the power adapter comprising:

a body portion;

a first connector terminal disposed in the body portion for receiving electrical power from a ground power unit;

a first cable electrically connecting the ground power unit to the first connector terminal;

a second connector terminal disposed in the body portion and electrically connected to the first connector terminal for supplying electrical power to the electrical system of the aircraft;

a second cable electrically connecting the second connector terminal to the electrical system of the aircraft;

a third connector terminal electrically connected and adjacent to the first connector terminal for supplying electrical power to the air conditioning unit;

a third cable electrically connecting the third terminal to the air conditioning unit; and a circuit breaker disposed within the body portion and electrically interposed between the first connector terminal and the third connector terminal, wherein the body portion is substantially rectangular, and the first connector terminal is opposite the second connector terminal.

5. The power adapter of claim 4, wherein the body portion is fabricated from a high-strength material.

6. The power adapter of claim 4, wherein the body portion is fabricated from steel.

7. The power adapter of claim 4, wherein the body portion is fabricated from aluminum.

8. The power adapter of claim 4, wherein the first connector terminal and the second connector terminal are axially aligned.

9. The power adapter of claim 4, further comprising:

the body portion having a bottom surface for supporting the body portion, a front surface that extends upward from the bottom surface, and a top surface that is spaced from the bottom surface by the front surface and a rear surface to define the height of the body portion; and wherein the height of the body portion is the smallest dimension of the body portion, the first connector terminal is disposed on the front surface of the body portion, and the second connector is disposed on the rear surface of the body portion.

10. The power adapter of claim 4, wherein the first connector terminal is a multiple pin male connector terminal and the second connector terminal is a multiple pin female connector terminal.

* * * * *